United States Patent [19]

Gottschalk

[11] 4,015,113

[45] Mar. 29, 1977

[54] APPARATUS FOR VARYING INTENSITY OF LIGHT

[76] Inventor: Robert E. Gottschalk, 10660 Chalon Road, Los Angeles, Calif. 90024

[22] Filed: May 2, 1975

[21] Appl. No.: 574,048

[52] U.S. Cl. ..... 240/41.35 R; 240/41.1; 240/103 R

[51] Int. Cl.[2] ..... F21V 7/00

[58] Field of Search ..... 240/1.3, 41.1, 41.15, 240/1.4, 46.47, 41.35 R, 103 R

[56] References Cited

UNITED STATES PATENTS

| | | | |
|---|---|---|---|
| 1,493,426 | 5/1924 | Bowman | 240/46.31 |
| 1,604,520 | 10/1926 | Kleese | 240/46.05 |
| 1,725,117 | 8/1929 | Walthers | 240/46.07 X |
| 3,382,353 | 5/1968 | Wappler | 240/1 LP |
| 3,775,606 | 11/1973 | Bazell et al. | 240/1 LP |

*Primary Examiner*—Richard L. Moses
*Attorney, Agent, or Firm*—Lyon & Lyon

[57] ABSTRACT

Apparatus for varying the intensity without changing the color quality of light derived from an artificial light source includes an arcuate row of pivotally mounted cylinders. Each cylinder has at least two surface areas of different reflectivity so that orientation of each cylinder provides a selectively variable composite reflectivity for all cylinders.

16 Claims, 6 Drawing Figures

APPARATUS FOR VARYING INTENSITY OF LIGHT

BACKGROUND OF THE INVENTION

This invention is directed to lamps, and is particularly directed to apparatus for varying the intensity of a light source without changing its color quality.

In motion picture production, it is often advantageous to vary the amount of light on a subject. Such an instance occurs when the subject is moved closer to the camera and light source during filming. Certain electrical controls, including rheostats, have been successfully employed for varying the intensity of light. However, as the intensity is varied, the color quality changes with such devices. This change may be imperceptible to the human eye; however, color film is easily affected by a color quality change. Shutters and other similar devices are also not highly practical as they tend to cast shadows on the object being photographed. These problems are especially acute in motion picture production with lights used very close to the camera as a means for relieving shadows on the subject. Naturally, problems resulting from changes in light intensity may arise in other than motion picture production.

SUMMARY OF THE INVENTION

The present invention is directed to an apparatus used in a lamp assembly for varying intensity of light from the lamp light source without varying the color quality of the light. Light from an unvarying source is directed into the apparatus which employs selectively varying degrees of reflectivity as a means for controlling the intensity of light emitted from the lamp assembly. The selectively varying degrees of reflectivity are provided by a plurality of members pivotally mounted in a frame. The members are preferably controlled such that they may be pivoted in unison. Each of the members has at least two surface areas exhibiting a different surface reflectivity. These areas are arranged such that the members may be pivoted to expose either of the two areas or a combination of the two areas to the unvarying light from the light source. By controlling the positions of the members, the amount of reflected light may be controlled without affecting the color quality. It has been found that cylindrical members having a knurled surface with 50 percent of that surface being coated with a black, non-reflective material provide excellent results for lamps used for fill-in light for motion picture production.

Accordingly, it is an object of the present invention to provide a means for controlling the intensity of light without affecting its color quality.

It is another object of the present invention to employ an apparatus having selectively varying reflectivity as a reflector in a lamp. Moreover, it is an object of the present invention to provide an apparatus for providing a variable intensity lamp where a uniform color quality is retained.

Other and further objects and advantages will appear hereinafter.

DETAILED DESCRIPTION OF THE DRAWINGS

Figures 2, 6:
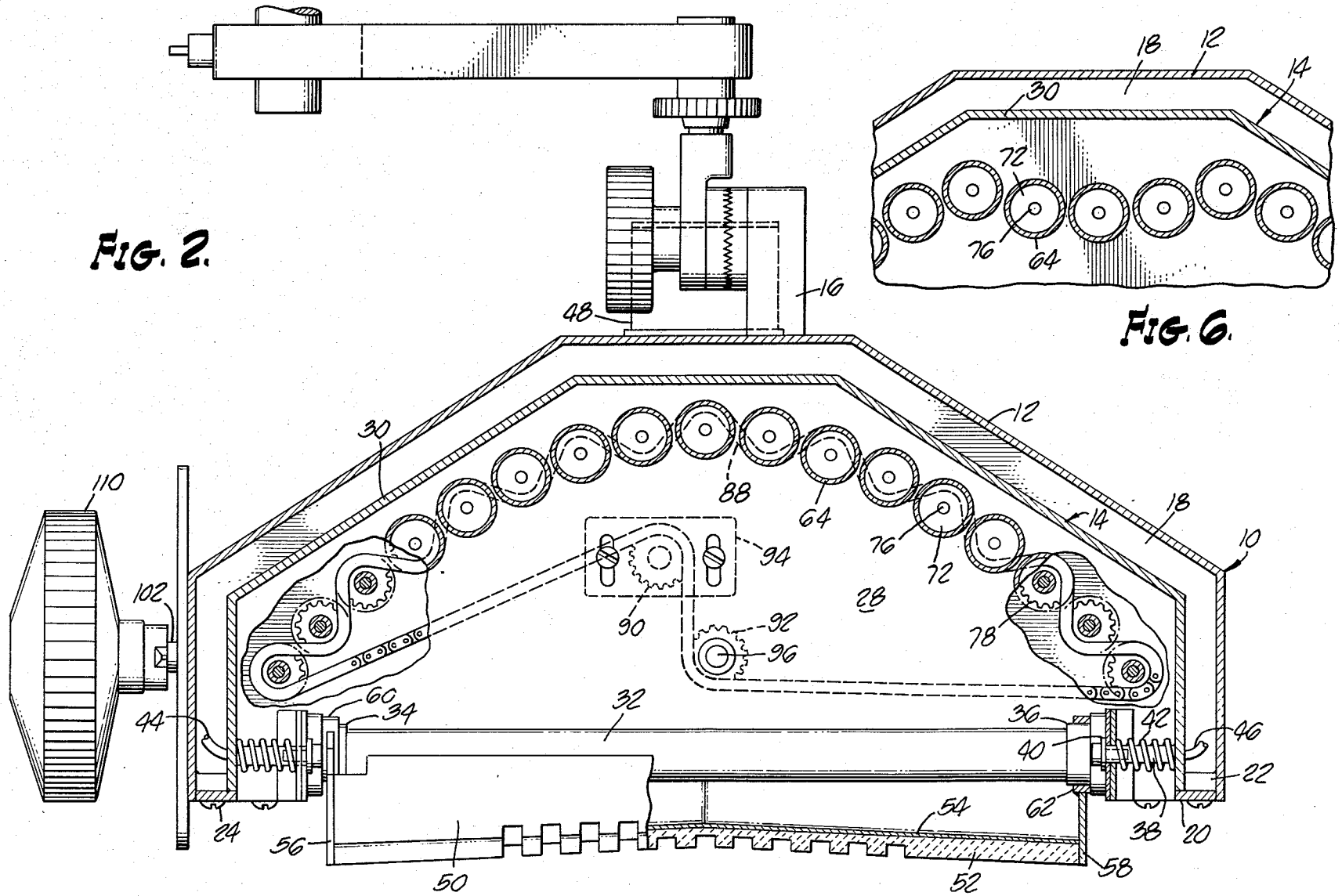
FIG. 2 is a sectional plan view taken along line 2—2 of FIG. 1.
FIG. 6 is a sectional plan view showing the apparatus in an alternate configuration.
Figure 3:
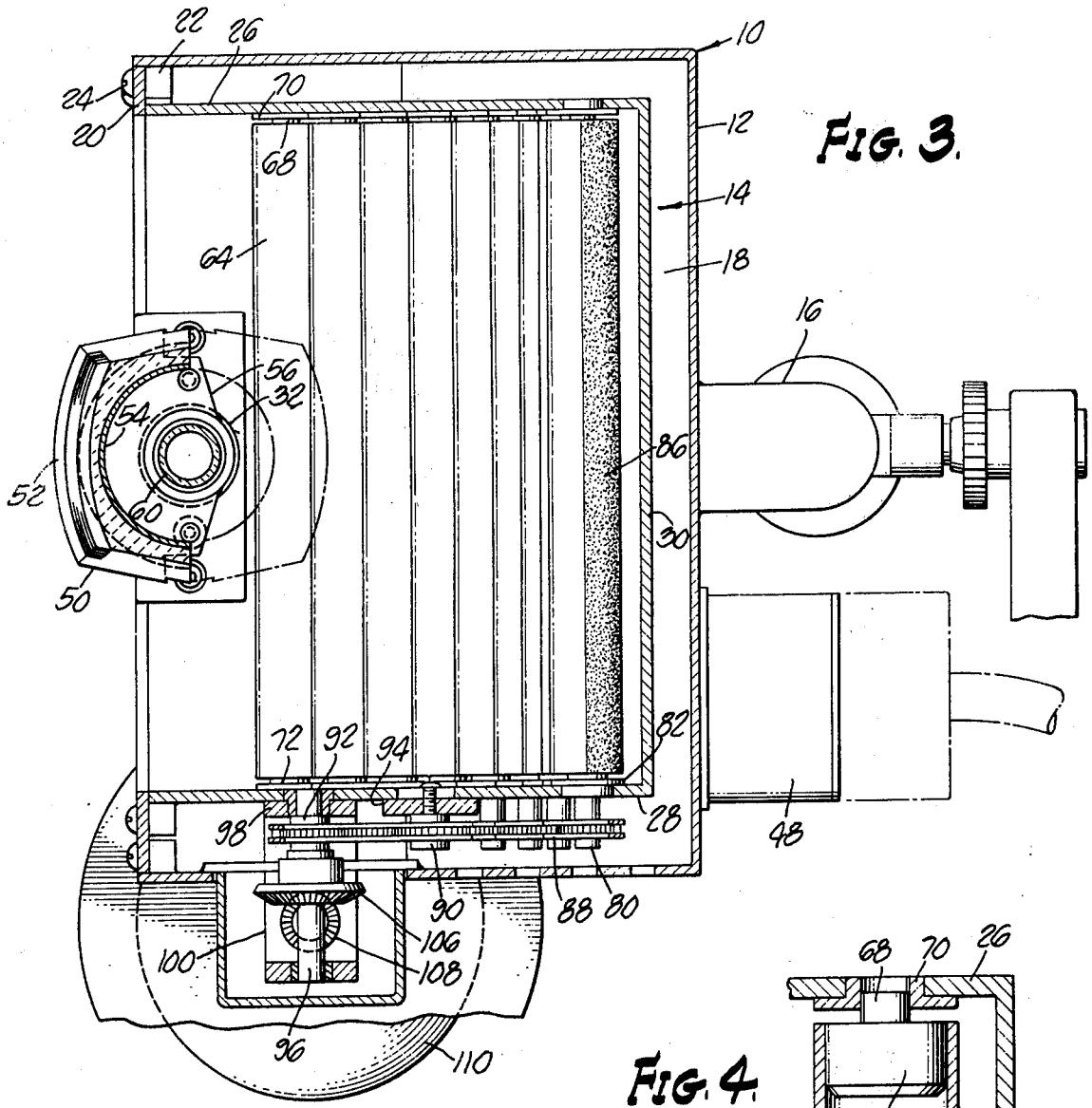
FIG. 3 is a sectional side view taken along line 3—3 of FIG. 1.
Figure 4:
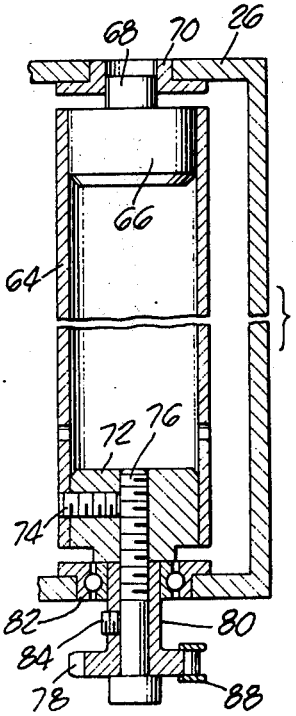
FIG. 4 is a sectional detail showing one of the pivotally mounted reflector members.

In the drawings, a lamp assembly generally designated 10, is illustrated as including a cover 12 and an inner housing 14. The cover 12 extends about all but one side of the apparatus and is preferably of lightweight sheet metal construction. A conventional support bracket 16 is rigidly attached to the back of the cover 12 as best seen in FIGS. 2 and 3. The inner housing 14 is shaped to fit within the cover 12 and displaced therefrom by a short distance. An air space 18 is thus formed between the cover 12 and the inner housing 14 which minimizes the conduction of heat to the cover 12. A substantially rectangular front cover 20 extends from the cover 12 to the inner housing 14 to enclose the air space 18 and to provide a means for attaching and supporting the inner housing 14 on the cover 12. Lugs 22 extend into the air space 18 for receipt of fasteners 24 positioned through the front cover 20.

The inner housing 14 includes upper and lower panels 26 and 28 and a back wall 30. The upper and lower panels 26 and 28 form an enclosure with the back wall 30 which extends rearwardly from either side of the front cover 20 and then diagonally converges to a flat back panel as can best be seen in FIG. 2. The back wall 30 may be formed into any shape necessary to encompass the operative elements of the present invention as will be more fully defined hereinafter.

A light source is provided at the front of the lamp assembly 10. The light source is illustrated in the present invention as being tubular lighting element 32 extending across the front of the housing. Resiliently mounted sockets 34 and 36 are provided at each end of and support the tubular lighting element 32. The sockets 34 and 36 are conventional components mounted on studs 38. These studs 38 each include a retaining ring 40 and a spring 42. Each spring 42 is placed in compression when the lighting element 32 is positioned in the sockets 34 and 36. Thus, the lighting element 32 is less vulnerable to damage and breakage. Wires 44 and 46 connect the sockets 34 and 36 with a plug 48 as a means for supplying electrical power to the lighting element 32.

A reflector shell 50 is positioned to cover about one-half of the tubular lighting element 32. Furthermore, the reflector shell 50 is positioned so that the portion of the tubular lighting element 32 covered is facing away from the housing. Thus, substantially all of the light emanating from the tubular lighting element 32 is directed into the inner housing 14. The reflector shell 50 includes a ceramic body 52 forming a semi-circular inner cavity having a stainless steel liner 54 to enhance reflectivity. End plates 56 and 58 extend from the ceramic body 52 inwardly to collars 60 and 62 which fit about the conventional sockets 34 and 36.

Pivotally mounted within the inner housing 14 and extending from the lower panel 28 to the upper panel 26 are a plurality of parallel reflector members 64. In the present embodiment, there are 17 such members 64 illustrated. These members are cylindrical and are preferably made of a material such as metal, having a fairly high degree of reflectivity. It is further preferable that the members 64 do not selectively absorb specific colors which would give a distinctive color to the light reflected by the members 64. Further, the surface of the members 64 may be knurled to increase the diffusion of the light as it is reflected off of the members 64.

The size and exact shape of the members 64 are not critical for good results. It is preferred that the members 64 substantially hide the back wall 30 in order that light will not be reflected from the back wall 30 over which there is no selective control of reflectivity. Thus, for the same size lamp, as the diameter of each member 64 decreases, more members 64 will be necessary. A greater uniformity in reflectivity will be achieved with a larger number of members 64; however, additional members 64 would add to the complexity and cost of each unit. As a diffuse reflection is desired with such lamps, it has been found that an increased number of members 64 would not be of any substantial benefit. The several members 64 are arranged in the preferred embodiment in an arcuate row. Other arrangements such as illustrated in FIG. 6 may be employed.

Each member 64 has a hub 66 positioned in the upper end thereof. The hub 66 includes a journal 68 which extends into a bearing 70. The bearing 70 is press fit into a hole in the upper panel 26.

At the lower end of each member 64, a hub 72 is positioned within the cylindrical member 64. A set screw 74 insures that the hub 72 will remain in position. A bolt 76 extends through the hub 72. The set screw 74 further retains the bolt 76. A sprocket 78 is positioned about the bolt 76 adjacent the hub 72. The sprocket 78 includes an extended hub 80 held in a bearing 82. The sprocket 78 is also fixed relative to the bolt 76 as is the member 64 by set screw 84. Thus, the member 64, hub 66 and sprocket 78 turn together as a unit. The bearing 82 is fixed in the lower panel 28 directly below the bearing 70 such that the member 64 is pivotally mounted within the inner housing 14 about an axis substantially perpendicular to the planes of the upper and lower panels 26 and 28.

Figure 5:
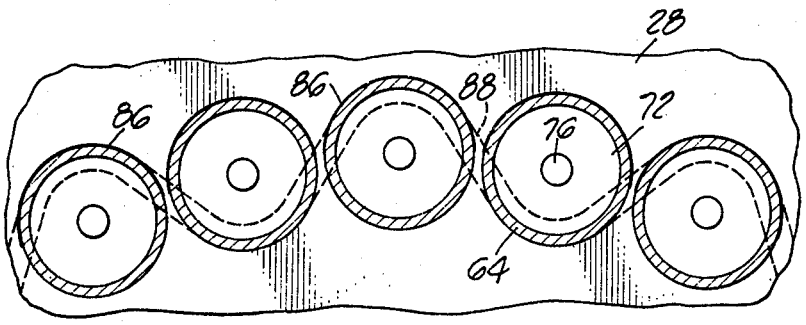
FIG. 5 is a sectional plan view partly broken away showing some of the pivotally mounted members and showing a coating on one side of each member.

The members 64 each include at least two surface areas of different reflectivity. FIG. 5 illustrates a coating 86 about a semi-circular segment of each of the members 64. The coating 86 may be black paint or the like which has a relatively low reflectivity to contrast with the unpainted area of each member 64. The two areas meet at boundary lines which are substantially parallel to the pivot axis of the members 64. In this way, the areas are defined such that either the reflective or non-reflective surfaces may be substantially hidden from the light source. Alternately, the ratio of reflective to non-reflective area exposed on each member 64 to the unvarying light source may be easily controlled. When the coatings 86 are away from the light source, the apparatus provides a maximum reflectivity. When the coatings 86 are facing the light source, the apparatus provides a minimum reflectivity. Therefore, the intensity of the light which is directed from the inner housing 14 is directly controlled by the pivotal position of each of the members 64. Furthermore, by positioning the members 64 such that a portion of each of the two surfaces are exposed, any degree of reflectivity between the maximum and minimum configurations may be obtained. Again, as the present arrangement provides a diffuse reflected light, the pattern of reflective and non-reflective surfaces does not show up on the illuminated subject. As the reflective surface area is designed to reflect light without absorbing certain colors, and the non-reflective surface is designed to absorb all colors, the color quality is not altered by the variation in reflectivity.

In order that the reflectivity may be easily and quickly changed, a linkage means is provided which simultaneously controls the pivotal position of each of the members 64. In the present embodiment, a chain 88 extends about and is linked with each sprocket 78 of the members 64. Each of the members 64 is initially placed so that the reflective surface of each member 64 is oriented toward the light source before the chain 88 is positioned about each sprocket 78. As the sprockets 78 are identical, the members 64 will always rotate so that the same ratio of reflective surface to non-reflective surface will face the light source for each member 64. The chain 88 is wound in first one direction and then the other about succeeding sprockets 78 such that each succeeding member 64 will rotate in the opposite direction. Thus, the non-reflective surfaces will not all appear on the same side of each member 64 as the linkage means is manipulated. If it is desirable to have the non-reflective surfaces all appear on the same side of each member 64 as the members are rotated in unison, the chain may be positioned along the back side of each of the sprockets 78.

The chain 88 is wound about the sprockets 76 as previously described, and then extends to the center of the frame. A tensioning sprocket 90 is positioned to receive the chain 88 as it extends inwardly from one end of the row of members 64. A control sprocket 92 receives the chain as it is directed inwardly from the other end of the row members 64. The chain 88 being continuous, it then extends from the control sprocket 92 to the tensioning sprocket 90. The tensioning sprocket 90 is mounted to the underside of the lower panel 28 on a mounting plate 94 which may be adjusted toward or away from the control sprocket 92 to effect the proper tensioning of the chain 88.

Figure 1:
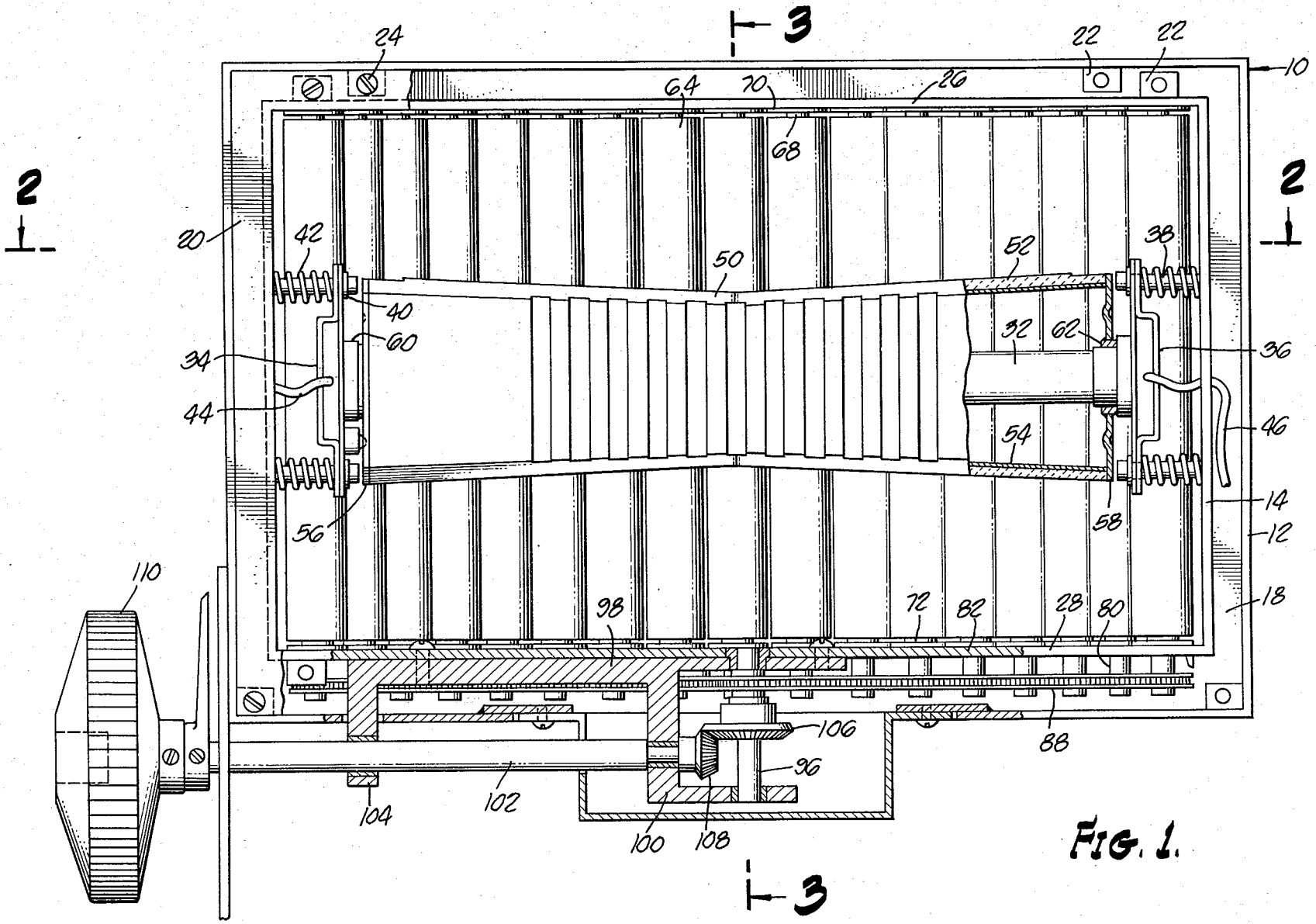
FIG. 1 is a front elevation, partly in section, showing a preferred embodiment of the present invention.

The control sprocket 92 is positioned on a shaft 96 which is rotatably mounted in a bracket 98. The bracket 98 is rigidly fixed to the inner housing 14 as can best be seen in FIG. 1. An arm 100 of the bracket 98 extends to support the lower end of the shaft 96 while the upper portion of the bracket 98 supports the upper end of the shaft 96. The arm 100 also supports a control shaft 102 as does leg 104 of the bracket 98. A bevel gear 106 is fixed to the shaft 96 and a bevel gear 108 is fixed to the control shaft 102. The gears 106 and 108 are meshed; consequently, rotation of the control shaft 102 causes rotation of the bevel gear 106, the shaft 96 and in turn the control sprocket 92. Rotation of the control shaft 102 thereby effects rotation of the members 64. A knob 110 is fixed to one end of the control shaft 102 to enhance manual control of the apparatus.

Thus, through manipulation of the knob 110, the reflectivity of the apparatus is altered to vary the intensity of light reflected without varying its color quality. Therefore, a lamp is disclosed which provides selectively variable intensity with constant color control. While embodiments and applications of this invention have been shown and described, it would be apparent to those skilled in the art that many more modifications are possible without departing from the inventive concepts herein described. The invention, therefore, is not to be restricted except by the spirit of the appended claims.

What is claimed is:

1. Reflector apparatus for use with a light source for varying the intensity of light received from said light source, comprising: a housing; and a plurality of adjacent reflector members each pivotally mounted for relative movement on said housing and positioned to reflect diffused light toward the light source, each of said members having at least first and second surface areas which receive light from said source, said first surface area having an average reflectivity different from the average reflectivity of said second surface area, and means for turning said reflector members.

2. The apparatus of claim 1 wherein said first and second surface areas of each said member have a mutual boundary substantially parallel to the pivotal axis of said member.

3. The apparatus of claim 2 wherein said second area is coated with a non-reflective black material.

4. The apparatus of claim 2 wherein said first and said second surface areas have a second mutual boundary substantially parallel to the pivotal axis of said member.

5. The apparatus of claim 4 wherein said first surface area and said second surface area are convex and equal in area.

6. The apparatus of claim 1 further comprising linkage means for controlling the orientation of each of said plurality of members about the pivotal axis of each of said plurality of members.

7. Reflector apparatus for use with a light source for varying the intensity of light received from said light source, comprising: a housing; a plurality of members pivotally mounted on said housing, each of said plurality of members having at least first and second surface areas which receive light from said light source, said first surface area having an average reflectivity different from the average reflectivity of said second surface area, and linkage means for controlling the orientation of said plurality of members about the pivotal axis of each of said plurality of members, said linkage means including a sprocket fixed to pivot with each said member and a chain engaging said sprockets on each of said members.

8. The apparatus of claim 7 wherein said chain passes in an opposite direction about each succeeding sprocket.

9. Reflector apparatus for use with a light source for varying the intensity of light received from said light source, comprising: a housing; a plurality of cylindrical members pivotally mounted on said housing, each of said members having at least first and second surface areas which receive light from said source, said first surface area having an average reflectivity different from the average reflectivity of said second surface area.

10. Reflector apparatus for use with a light source for varying the intensity of light received from said light source; comprising: a housing; a plurality of members pivotally mounted on said housing, each of said plurality of members having at least first and second surface areas which receive light from said source, said surface areas being knurled, said first surface area having an average reflectivity different from the average reflectivity of said second surface area.

11. Apparatus for varying the intensity of light received from a light source without changing the color quality of the said light, comprising, in combination: a frame, means for supporting a light source on the frame, a series of adjacent movable members cooperating to form a reflector for reflecting light back toward said light source, means for mounting each of said members for turning movement on the frame, each member having outer surface areas of different reflectivity.

12. The combination set forth in claim 11 in which said outer surface areas of each movable member include a black side and a bright side.

13. The combination set forth in claim 11 in which the members are cylindrical and are mounted to turn about their respective axes.

14. Apparatus for varying the intensity of light received from a light source without changing the color quality of the said light, comprising, in combination: a frame, means for supporting a light source on the frame, a series of adjacent movable members cooperating to form a reflector for reflecting light back toward said light source, the shape and position of said members minimizing passage of light between said members, means for mounting each of said members for turning movement on the frame, each member having two outer surface areas of different reflectivity.

15. Apparatus for varying the intensity of light reflected from a light source without changing the color quality of the reflected light, comprising, in combination: a frame, means for supporting a light source on the frame, a series of adjacent movable members cooperating to form a reflector for reflecting light back toward said light source, the shape and position of said members minimizing passage of light between said members, each member having two outer surface areas of different reflectivity, means for mounting each of said members for turning movement on the frame, and means for turning all of said members simultaneously.

16. Apparatus for varying the intensity of light reflected from a light source without changing the color quality of the reflected light, comprising, in combination: a lamp assembly including a frame, an elongated horizontal incondescent lamp serving as a light source, a stationary reflector encompassing one side of the incondescent lamp to direct light in one direction, a series of vertically extending adjacent movable cylindrical members cooperating to form a reflector for reflecting light back toward said light source, each of said members having two outer surface areas of different reflectivity, and means for turning said members.

* * * * *